US006661327B1

(12) United States Patent
Funk

(10) Patent No.: US 6,661,327 B1
(45) Date of Patent: Dec. 9, 2003

(54) ELECTROMAGNETIC INDUCTOR AND TRANSFORMER DEVICE AND METHOD MAKING THE SAME

(75) Inventor: Traugott Funk, Marienheide-Kalsbach (DE)

(73) Assignee: Netec AG (DE)

( * ) Notice: Subject to any disclaimer, the term of this patent is extended or adjusted under 35 U.S.C. 154(b) by 0 days.

(21) Appl. No.: 10/171,221

(22) Filed: Jun. 12, 2002

(51) Int. Cl.[7] ..... H01F 27/24

(52) U.S. Cl. ..... 336/212; 336/60; 336/61; 336/178; 29/602.1

(58) Field of Search ..... 336/60, 61, 200, 336/212, 83, 183, 58, 178; 29/602.1, 606

(56) References Cited

U.S. PATENT DOCUMENTS 3,789,494 A * 2/1974 Bostrom et al. ..... 29/423
4,201,089 A * 5/1980 Felber et al. ..... 374/152

* cited by examiner

*Primary Examiner*—Anh Mai
(74) *Attorney, Agent, or Firm*—Norris, McLaughlin & Marcus, P.A.

(57) ABSTRACT

An electromagnetic inductor and transformer device and a method for making the same are disclosed. The device has a core that is separated into core sections along a dividing plane that extends essentially parallel to the magnetic field in the core. At least one cooling gap is formed between the core sections along the dividing plane to facilitate heat removal from the interior of the inductor and transformer device to the outside.

17 Claims, 5 Drawing Sheets

A5

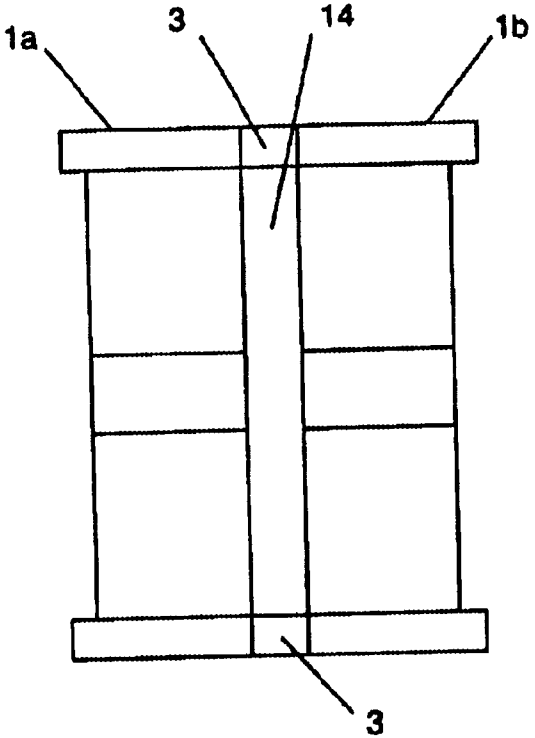
Fig. 2.3
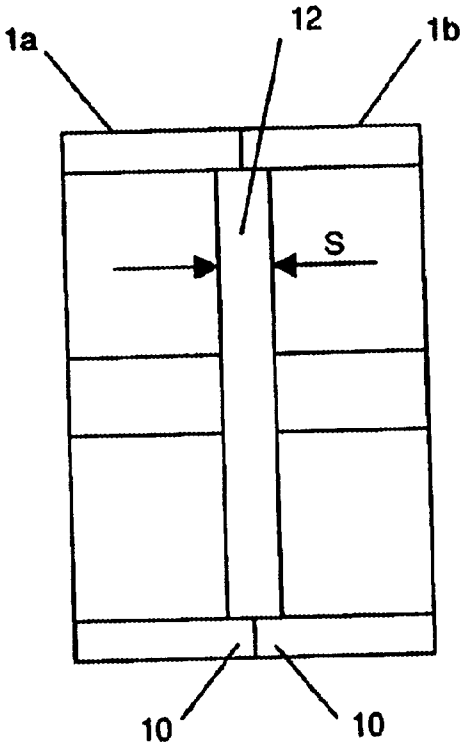
Fig. 2.2
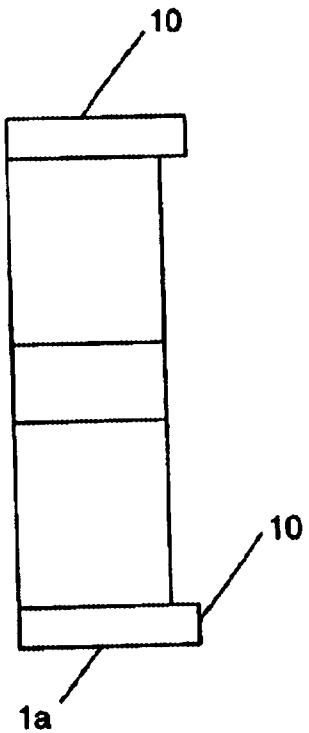
Fig. 2.1

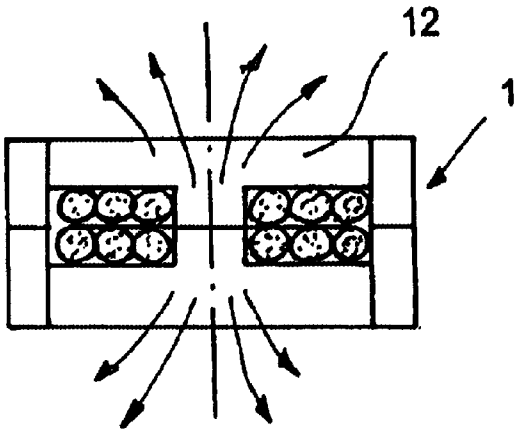
Fig. 3.2
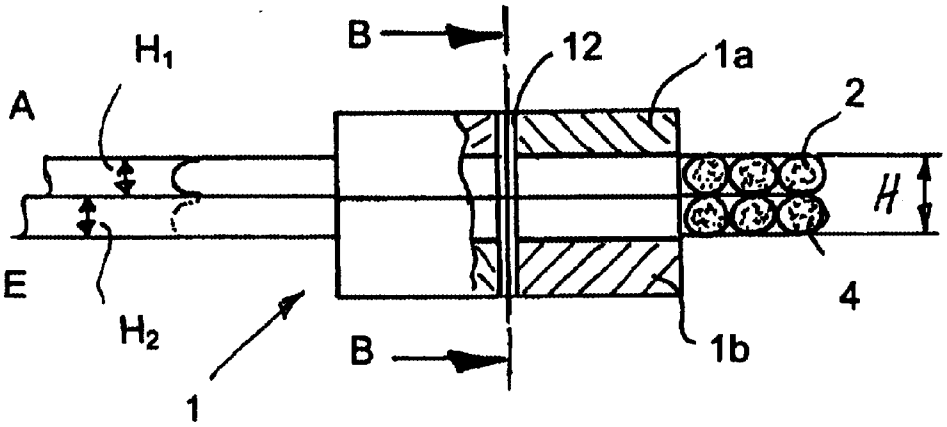
Fig. 3.1

Fig. 5.1
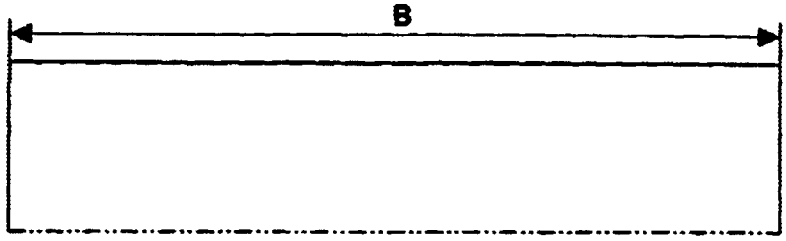
Fig. 5.2
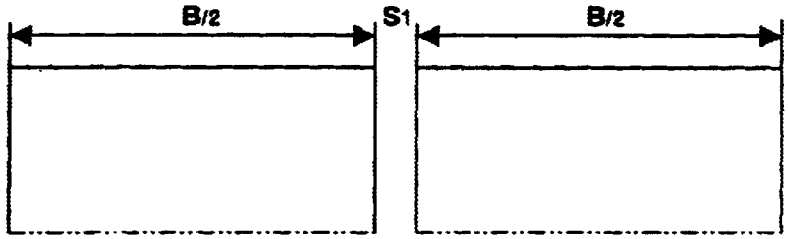
Fig. 5.3
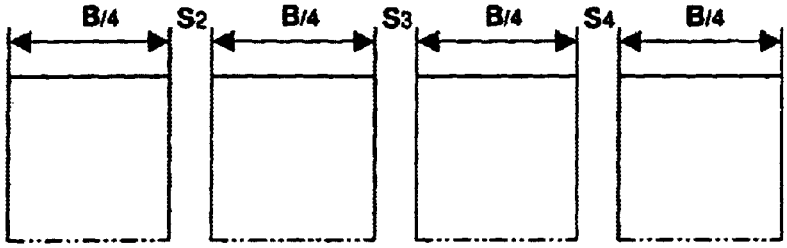
Fig. 5.4
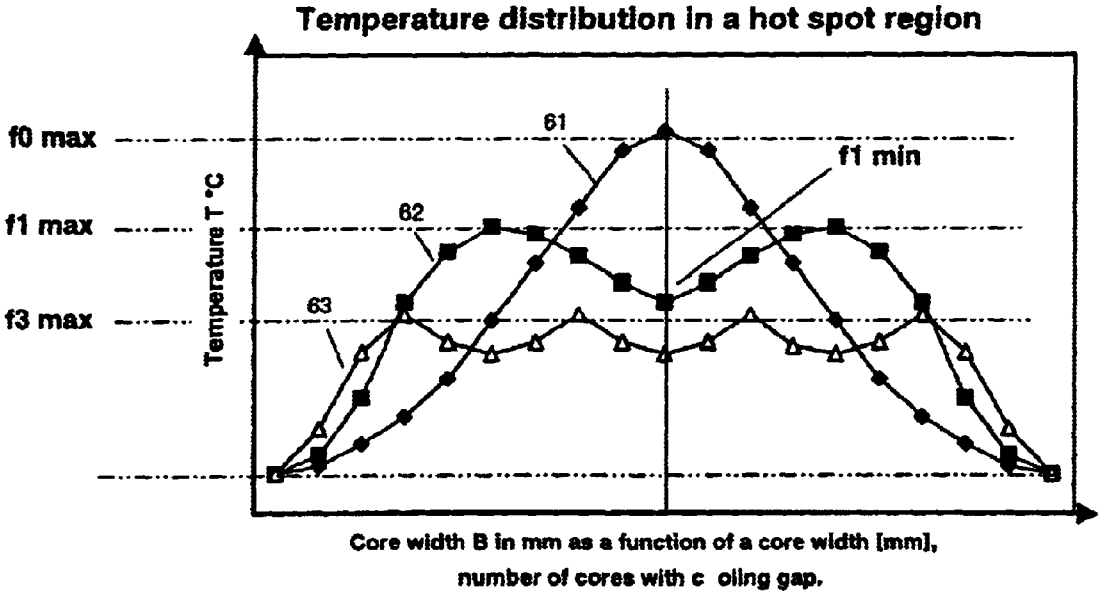

ELECTROMAGNETIC INDUCTOR AND TRANSFORMER DEVICE AND METHOD MAKING THE SAME

FIELD OF THE INVENTION

The invention relates to an electromagnetic inductor and transformer device with at least 2 helical windings formed by planar technique into a coil as well as a core which amplifies an effect of the magnetic field lines created inside the adjacent windings of the coil.

BACKGROUND OF THE INVENTION

High power transformer units typically include several coils and a metallic core, for example, a ferromagnetic or ferrimagnetic core, which magnetically couples the coils. The common alternating magnetic field can transform the voltage from a grid with one particular AC voltage to a different grid with a different AC voltage. Different types of coils and coil-shaped elements for such electrical or inductive components are known in the art.

For example, GB-A-2 260 222 discloses a coil made of a plurality of flat conductors that are arranged in a planar configuration. The flat conductors which are arranged side-by-side are connected at the center or inside of the coil by spot welding. To provide a sufficient large contact area for spot welding, the conductor ends project far into the coil center which considerably degrades the electrical efficiency.

Gaps can open and deposits can form at the connection points between several conductors which can aggravate corrosion. Moreover, inwardly projecting conductor ends affect the installation conditions. This results in performance limitations which will be described in detail hereinafter.

Coil bodies for wire-wound induction coils as well as planar transformers are designed for various efficiency and installation conditions, depending on the application. Conventional inductive elements can satisfy to some degree certain common requirements, in spite of the different applications:

a)Overall Size

The starting and end pieces that are formed when the coils are wound are typically connected to the outside. The overall size of multi-layer coils can be unnecessarily increased by cross connections (see U.S. Pat. No. 5,355,301; 4,873,757; 5,027,255; and 4,547,961).

b)Uniform Conductor Cross-section

The coils of planar transformers are formed of individual flat windings which are connected to each other by contacts. This produces joints which are subject to corrosion. Moreover, high currents can produce open circuits and arcing.

c)Electrical Efficiency

It is known that sharp corners and edges—such as those occurring in cross connections in coils—negatively affect the electric field lines. This causes a superposition and attenuation of the electric field and a degradation of the electric flux.

These electric field perturbations that can also negatively affect or interfere with surrounding components.

It would therefore be desirable to improve the cross-sectional efficiency of electro-magnetic inductor and transformer devices and to increase the power density by reducing the overall dimensions of the component, and more particularly, to achieve a uniform temperature distribution and to prevent hot spots.

It is further desirable that the new device can be used under high power without failure.

SUMMARY OF THE INVENTION

The invention is directed to an electromagnetic inductor and transformer device with at least two helical windings formed by planar technique to a coil as well as a core which amplifies an effect of the magnetic field lines created inside the adjacent windings of the coil.

According to one aspect of the invention an inductor and transformer device is characterized in that the coil having a starting section A and an end section E consists of one continuously formed conductor wound alternatingly from an inside to an outside of the interior space of the planar inductor and transformer device and vice versa to produce a microscopic homogeneous coil winding with corresponding magnetic field lines and wherein the core is divided by at least one dividing plane extending substantially parallel to the magnetic field lines with a cooling zone disposed in said parallel dividing plane which cooling zone for the purpose of heat removal extends from the interior space of the inductor and transformer device to the outside.

According to another aspect of the invention the inductor and transformer device includes a core that amplifies the effect of a magnetic field, wherein the core is divided into at least two core sections along planes that extend essentially parallel to the magnetic field in the core. At least one cooling gap is disposed between the core sections and oriented substantially parallel to a plane dividing the core sections. The cooling gap extends to an area located outside the core so that heat can be removed from the interior of the inductor and transformer device.

Its has been observed that heat can be removed more efficiently from the interior of the inductor and transformer device by dividing the core parallel to the magnetic flux lines. Hot spot can be eliminated by cooling the heated region of the divided core with a coolant fluid. Several cooling gaps can be formed in the region of the divided core, wherein the temperature between the cooler and the hotter regions can be evened out by convection cooling and/or by providing a strong coolant flow.

Embodiments of the invention may include one or more of the following features.

The core sections can be made of a ferrimagnetic or ferromagnetic material and the width of the cooling gap can be adjustable. A cooling element, which can include a cooling finger, can be provided for insertion in the cooling gap. The cooling element or cooling finger can be made of a non-magnetic materials with a high thermal conductivity, such as aluminum, an aluminum alloy or another light metal alloy. The core sections can be E-shaped and arranged in an opposing relationship, and one or more cooling gaps can be placed in the plane dividing the central yoke portion.

Further features and advantages of the present invention will be apparent from the following description of preferred embodiments and from the claims.

BRIEF DESCRIPTION OF THE DRAWINGS

The following figures depict certain illustrative embodiments of the invention in which like reference numerals refer to like elements. These depicted embodiments are to be understood as illustrative of the invention and not as limiting in any way.

FIG. 2.1 is a top view of an E-shaped core section of an inductor or a transformer device with integral projections for forming a cooling gap;

FIG. 2.2 is a top view of two juxtaposed E-shaped core sections with a cooling gap formed therebetween;

FIG. 2.3 is a top view of two juxtaposed E-shaped core sections with a cooling gap formed by spacers;

FIG. 3.1 is a partial- cross-sectional view through an electromagnetic inductor device according to a first embodiment of the invention;

FIG. 3.2 is a cross-section taken along the line B—B of FIG. 3.1;

FIG. 5.1 shows schematically in cross-section a core without a cooling gap;

FIG. 5.2 shows schematically in cross-section a core with one cooling gap;

FIG. 5.2 shows schematically in cross-section a core with three cooling gaps;

FIG. 5.4 is a schematic diagram of the temperature distribution in the inductors of FIGS. 5.1–5.3 along their width for cores without a cooling gap, with one cooling gap and with three cooling gaps.

DETAILED DESCRIPTION OF CERTAIN ILLUSTRATED EMBODIMENTS

The invention is directed to electromagnetic inductor and transformer devices and more particularly to efficient cooling of such devices.

Figure 1:
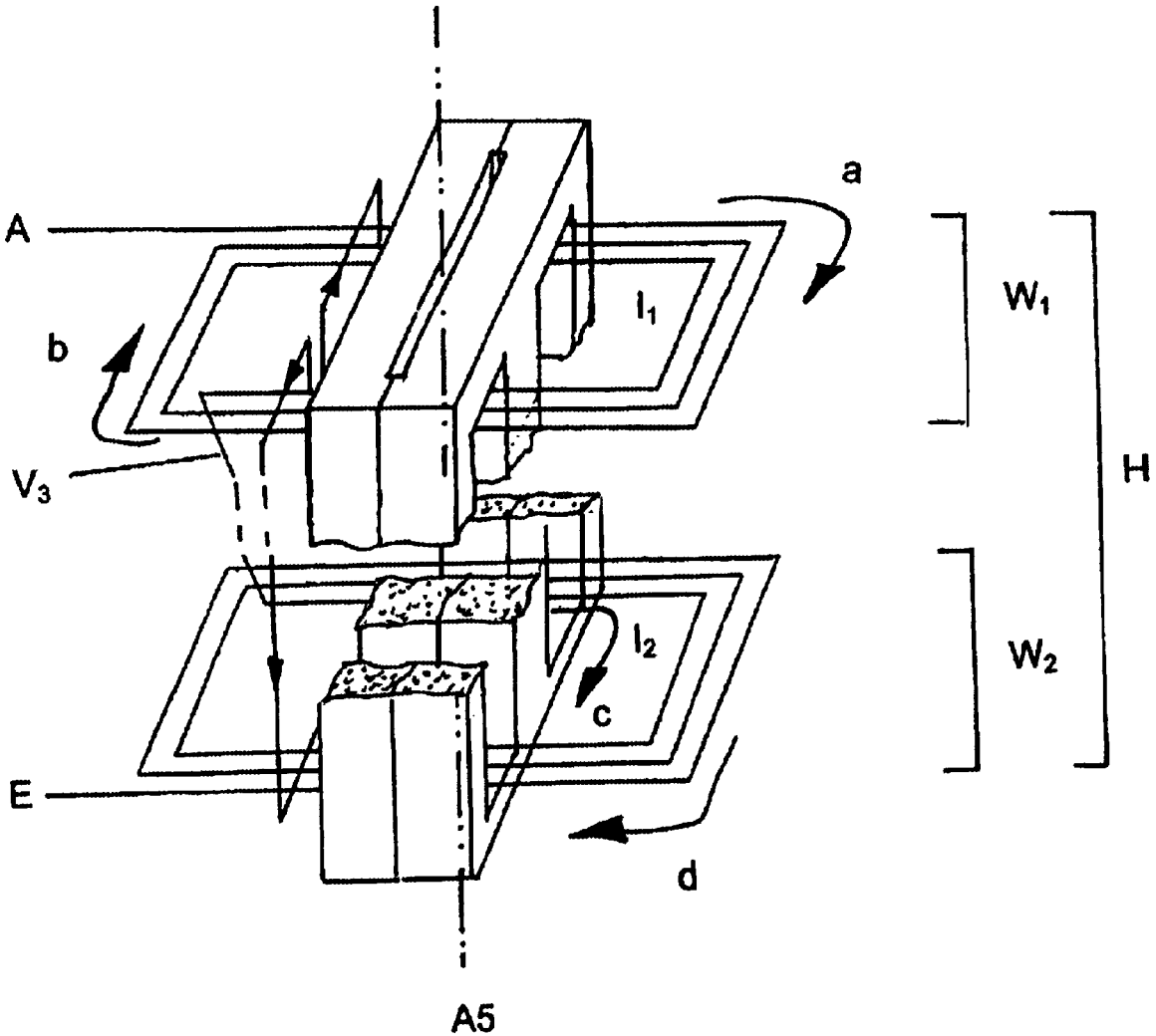
FIG. 1 shows an elevated view of an electromagnetic inductor according to the invention.

FIG. 1 illustrates the basic construction of an inductor device according to the invention, with starting and end sections A, E of a conductor material forming helical windings W1, W2. As seen from arrows a–d FIG. 1, the conductor material is wound alternatingly around a core 1 from the outside to the inside (arrows a,b) and then from the inside to the outside (arrows c,d) of the inductor device wherein the overall height H of the coil is determined by the width of the conductor material.

A connecting conductor V3 extends parallel to the coil axis A5 in the center of the windings at the transition between the inner regions. This provides a particularly space-saving connection between the windings W1, W2. Alternatively, tangentially extending connecting conductors (not shown) can also be used to connect the windings W1, W2 with one another.

FIGS. 2.1–2.4 depict different views of inductor and transformer devices according to the invention having an E-shaped core or a double-E-shaped core. The windings are not shown. For example, FIG. 2.1 is a top view of an E-shaped core section 1*a* with projections 10 disposed on end sections of the core section 1*a*. Two of such core sections 1*a*, 1*b* can be arranged side by side, as depicted in FIG. 2.2, with the projections 10 facing each other and forming a gap 12 with a width S between the core sections 1*a*, 1*b*. The gap 12 can be part of the air gaps and/or cooling gaps arranged in the core. As shown in FIG. 2.3, the width of the gap 14 can also be adjusted with spacers 3 provided instead of or in addition to the projections 10.

As mentioned above, the center of the core and in the interior of the coil can severely overheat due to the dissipated power caused by copper losses and core losses. The gap width of the cooling gap 14 can be adjusted with the help of the spacers 3, so that the temperature can be evened out through convection cooling. The spacers can be formed as separate elements, as shown in FIG. 2.3, or as a single piece that spans several gaps (not shown). The spacers can also be formed as part of the core(s), as shown in FIG. 2.1, so that the cooling gap(s) can have various different designs and shapes.

FIG. 3.1 depicts an inductive element that also includes windings 2,4 which are arranged symmetrically to a coil axis which extends parallel to the line B—B. The sum of the winding width $H_1$, $H_2$ form the overall height H of the coil.

The conductor and thereupon the coil manufactured according to the invention has an absolute constant cross-section and is made of a microscopic homogeneous material. "Microscopic homogeneous" means that the metallurgical appearance of the conductor is totally homogeneous from A to E without interruptions, discrepancies or variations in the chemical or physical aspect. A continuous conductor is formed into two planar and helical coils that are wound in opposite directions with respect to their planar plane. They produce a very homogeneous electromagnetic field due to the constant conductor cross-section.

Figure 4:
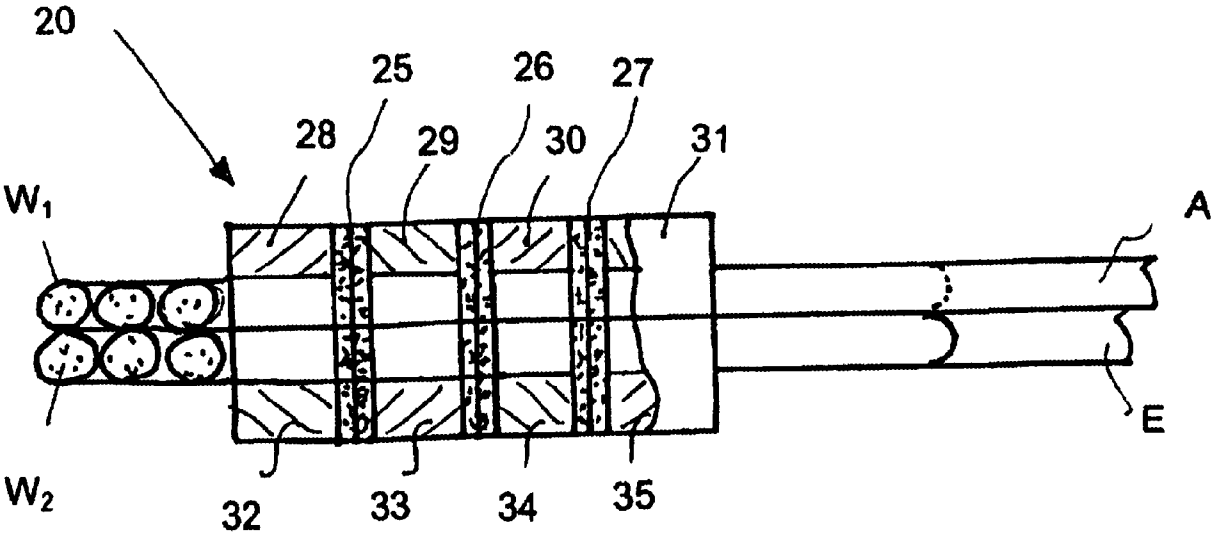
FIG. 4 shows a second embodiment of an electromagnetic inductor with three cooling gaps.

The new inductor and transformer can be exposed to very high temperatures since it does not include weakened materials or weakened zones in the form of welds or solder joints of the conductor but is totally homogeneous. The performance under high temperature or power density can be further improved by the installation of a cooling gap 12 as shown in FIGS. 3.1 and 3.2. The cooling gap 12 is formed in the center of the core 1 to eliminate the heat from the inside. This has been illustrated by arrows in FIG. 3.2 which is a cross sectional view along BB of the embodiment shown in FIG. 3.1. It can be seen that the gap 12 reaches from one side of core 1 to the other side so that the coolant can pass through. As an alternative to the embodiment shown in FIG. 3.1, an inductor 20 with three cooling gaps 25, 26, 27 is illustrated in FIG. 4. The inductor 20 can have eight core sections 28–35 and one conductor with end sections A and E. The gaps 25, 26, 27 can be open or filled with a cooling paste.

Figure 6:
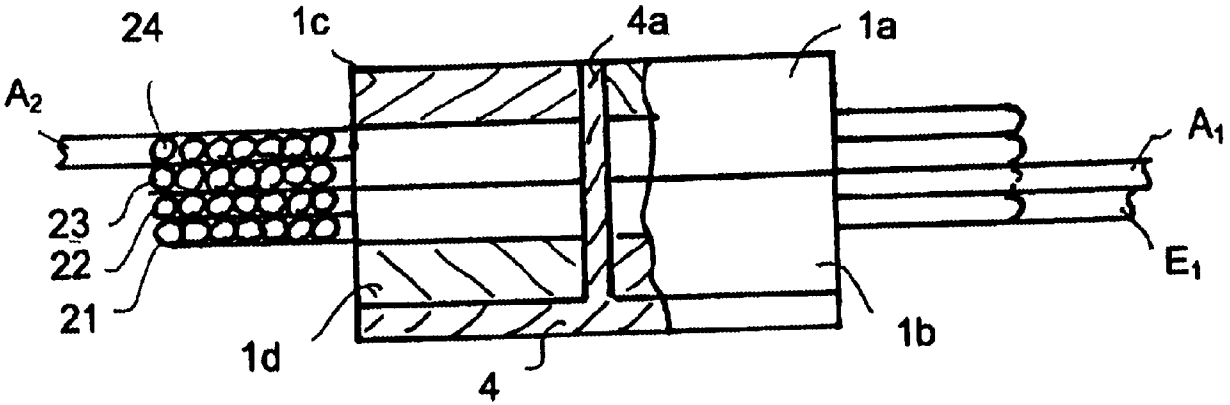
FIG. 6 shows a transformer according to the invention in a cross sectional view similar to FIG. 3.1

Referring now to FIG. 6 an exemplary transformer with double-E-shaped core includes core sections 1*a*, 1*b* and windings 21–24. Windings 21, 22 form the primary side of the transformer having end sections $A_1$, $E_1$ at one side of the core sections 1*c*, 1*d*, whereas windings 23, 24 form the secondary side with end sections $A_2$ and $E_2$ (not shown) at the complementary E-shaped core sections 1*a*, 1*b*. A cooling finger 4*a*, which is connected to a cooling element 4, can be inserted in or near the cooling gap. This arrangement strongly enhanced heat removal from the interior of the core. The cooling element 4, and particularly the cooling finger 4*a*, provide strong cooling in the region where the greatest heat dissipation is expected, so that the device can be thermally loaded to a higher limit than with a continuous undivided core without a cooling gap. Moreover, with the heat removed by the cooling element 4, less heat is transferred to neighboring components, so that less heat shielding is required. Accordingly, the overall dimensions of the components can be reduced by approximately 20%.

The cooling element 4 can be located on the inside (not shown) or the outside of the inductor and transformer device of the invention. The cooling element 4 can be made of a non-magnetic material with a high thermal conductivity, such as aluminum or an aluminum alloy. The cooling of element can remove the heat that is generated in the interior by the dissipated power to the outside. The heat removal can be improved by designing the surfaces of the cooling element 4 in specific ways, for example by employing cooling fins, etc. Alternatively, the heat could also be removed to the outside via a contact area disposed on a housing element of the transformer device (not shown).

In illustrated exemplary spread-apart windings, secondary windings are introduced in the open sections of the transformer. This design produces small stray inductances while keeping the size of the air gap and isolation spaces at a minimum.

Measurements have shown that the service life of inductor and transformer devices that are optimally cooled can be approximately doubled. This is particularly the case for transformers operating under high load, such as power transformers or multi-phase transformers.

Referring now to FIGS. 5.1–5.4, the effect of the number of cooling gaps (n) on the component temperature ($T_s$) for a typical inductor or transformer device can be estimated as follows:

The total number of temperature minima $S_i$ corresponds to the number n of cooling gaps. The core of FIG. 5.1 has a width B and no cooling gap; the core of FIG. 5.2 has two core sections, each having a width B/2 separated by one cooling gap with a width $S_1$; and the core of FIG. 5.3 has four core sections, each having a width B/4, and three cooling gaps therebetween with respective widths $S_2$, $S_3$ and $S_4$. The average component temperature $T_{av}$ between the core sections is then inversely proportional to the number n of the cooling gaps, the width $S_i$ of the cooling gaps, and the temperature $T_{gap}$ in the cooling gap, which is assumed to be uniform.

$$T_{av}=(n*S_i)^{-1}*T_{gap}$$

This relationship is schematically illustrated in FIG. 5.4. Shown are 3 temperature curves 61, 62, 63 for the three different core geometries depicted in FIGS. 5.1, 5.2, and 5.3. The first example applies to the undivided core (FIG. 5.1), with typical temperature curve showing a single maximum temperature $f_{0,max}$ in the center of the core (curve 61).

The second example (curve 62) applies to the divided core with a single cooling gap $S_1$ located approximately in the geometric center of the core (FIG. 5.2). The resulting temperature curve has a minimum in the center region of the core (indicated by $f_{1,\ min}$) and two adjacent temperature maxima $f_{2,\ max}$, which are less pronounced than the first temperature maximum $f_{0,max}$.

The third example (curve 63) applies to a core composed of four sections, which are each separated from one another by cooling gaps $S_2$, $S_3$, $S_4$ (FIG. 5.3). The resulting temperature curve has three minima $f_{3,\ min}$ corresponding to the cooling gaps $S_2$–$S_4$ which results in a more uniform temperature distribution. It is evident that the average temperature in the core and the temperature difference between the individual core regions decrease significantly with the number of cooling gaps.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. Electromagnetic inductor and transformer device comprising a core divided by at least one dividing plane and having a cooling gap disposed in said least one dividing plane, said cooling gap extending from an interior space of the inductor and transformer device to an outside region of the core, and at least one coil wound around at least a portion of the core and formed of a continuous conductor having a starting section and an end section, each coil having at least two planar helical winding sections, which are wound alternatingly from an inside to an outside of the interior space, and from the outside to the inside of the interior space, respectively, said at least one coil capable of producing magnetic field lines, wherein the at least one divining plane extends substantially parallel to the magnetic field lines.

2. The electromagnetic inductor and transformer device according to claim 1, wherein each of said at least two planar helical winding sections of the coil has a winding height $H_i$ and an overall height H of the coil corresponds to a sum of the winding heights $H_i$ of each of said at least two planar helical winding sections plus a width of an insulation material disposed between the winding sections.

3. The electromagnetic inductor and transformer device according to claim 1, wherein the starting section and the end section of the continuous conductor are brought to the outside region of the core.

4. The electromagnetic inductor and transformer device according to claim 1, wherein the starting section and the end section are connected to electrical terminals.

5. The electromagnetic inductor and transformer device according to claim 1, wherein the conductor comprises braided or stranded individual wires.

6. The electromagnetic inductor and transformer device according to claim 1, wherein the core is formed as a multi-part body made of iron or ferrite and the core sections are spaced apart by spacers so as to provide the cooling gap with a variable gap width.

7. The electromagnetic inductor and transformer device according to claim 1, further comprising at least one cooling element adapted for insertion in the at least one cooling gap.

8. The electromagnetic inductor and transformer device according to claim 7, wherein the at least one cooling element includes at least one cooling finger.

9. The electromagnetic inductor and transformer device according to claim 8, wherein the at least one cooling finger is implemented as a fill material of the cooling gap.

10. The electromagnetic inductor and transformer device according to claim 7, wherein the at least one cooling element is made of a non-magnetic material with a high thermal conductivity.

11. The electromagnetic inductor and transformer device according to claim 10, wherein the at least one cooling element is made of a material selected from the group of consisting of aluminum, aluminum alloys and light metal alloys.

12. The electromagnetic inductor and transformer device according to claim 1, wherein a coolant flows through the at least one cooling gap.

13. The electromagnetic inductor and transformer device according to claim 12, wherein the coolant comprises a cooling fluid.

14. The electromagnetic inductor and transformer device according to claim 12, wherein the coolant comprises a gas.

15. The electromagnetic inductor and transformer device according to claim 14, wherein the gas is moved through the cooling gap by convection.

16. The electromagnetic inductor and transformer device according to claim 1, wherein said core comprises at least two E-shaped core sections having legs, with the legs being arranged in an opposing relationship.

17. A method for producing a coil, comprising:

providing in a core made of a magnetic material, winding at least one coil around at least a portion of the core, each coil having at least two planar helical winding sections formed of a continuous conductor having a starting section and an end section, said winding sections wound alternatingly from an inside to an outside of the interior space, and from the inside to the outside of the interior space, respectively, said at least one coil capable of producing magnetic field lines, and providing in said core at least one dividing plane and a cooling gap disposed in said least one dividing plane, said cooling gap extending from an interior space of the inductor and transformer device to an outside region of the core, wherein an overall height of the at least one coil is obtained by adding corresponding winding heights of the at least two planar helical winding sections and a width of an insulation material disposed between the at least two planar helical winding sections.

* * * * *